US007279849B2

(12) United States Patent
Lee

(10) Patent No.: US 7,279,849 B2
(45) Date of Patent: Oct. 9, 2007

(54) APPARATUS FOR DRIVING BACKLIGHT OF LIQUID CRYSTAL DISPLAY

(75) Inventor: Jeong Geun Lee, Daegu (KR)

(73) Assignee: L.G.Philips LCD Co., Ltd., Seoul (KR)

( * ) Notice: Subject to any disclaimer, the term of this patent is extended or adjusted under 35 U.S.C. 154(b) by 0 days.

(21) Appl. No.: 11/454,853

(22) Filed: Jun. 19, 2006

(65) Prior Publication Data

US 2007/0132400 A1 Jun. 14, 2007

(30) Foreign Application Priority Data

Dec. 12, 2005 (KR) ..... 10-2005-0121890

(51) Int. Cl.
*H05B 37/02* (2006.01)
*H05B 37/00* (2006.01)
*H05B 41/16* (2006.01)

(52) U.S. Cl. ..... 315/220; 315/227 R; 315/277; 315/308

(58) Field of Classification Search ..... 315/209 R, 315/219, 220, 225, 226, 227 R, 246, 277, 315/291, 307, 308
See application file for complete search history.

(56) References Cited

U.S. PATENT DOCUMENTS

2006/0043900 A1* 3/2006 Ahn et al. ..... 315/56
2006/0061982 A1* 3/2006 Lee ..... 362/29

* cited by examiner

*Primary Examiner*—Thuy Vinh Tran
(74) *Attorney, Agent, or Firm*—McKenna, Long & Aldridge LLP

(57) ABSTRACT

This invention relates to a backlight driving apparatus of a liquid crystal display device, and more particularly to a backlight driving apparatus of a liquid crystal display device that includes: first and second transformers that boost an AC voltage to a boosted AC voltage that is supplied to a U-shaped lamp; and a virtual ground fixing device that causes a virtual ground of the U-shaped lamp to be fixed at the center of a bent part of the U-shaped lamp by causing the boosted AC voltage that is output from the first and second transformers to be identical in size.

18 Claims, 5 Drawing Sheets

APPARATUS FOR DRIVING BACKLIGHT OF LIQUID CRYSTAL DISPLAY

This application claims the benefit of Korean Patent Application No. P2005-0121890, filed on Dec. 12, 2005, which is hereby incorporated by reference for all purposes as if fully set forth herein.

BACKGROUND OF THE INVENTION

1 . Field of the Invention

The present invention relates to a liquid crystal display device, and more particularly to a backlight driving apparatus of a liquid crystal display device that may prevent a shift of a virtual ground point of a u-shaped lamp.

2 . Discussion of the Related Art

Generally, liquid crystal display devices (hereinafter, referred to as an LCD) are being more widely used due to its characteristics of light weight, thinness, low power consumption, etc. Because of these characteristics, the liquid crystal display device is used in office automation equipment, audio/video equipment, etc. The liquid crystal display device controls the amount of light transmitted through a liquid crystal layer in accordance with a video signal applied to a plurality of control switches that are arranged in a matrix, thereby displaying a desired picture on a screen.

The liquid crystal display device is not a self luminous display device, thus it requires a separate light source such as a backlight. Such a backlight may use a cold cathode fluorescent tube (hereinafter, referred to as a CCFL) as a light source.

The CCFL is a light source tube which uses an electron emission phenomenon generated by a strong electric field applied to the surface of a cold cathode, and it is easy to be made with low heat generation, high brightness, long life span, full colorization, etc. The CCFL includes a glass tube where a fluorescent material is spread on the inner wall thereof and an electrode that is stuck to both ends of the glass tube. The glass tube is sealed off with a rare gas like argon and a fixed quantity of mercury.

If a voltage is applied between electrodes of both ends of the glass tube, electrons are emitted to ionize the gas within the glass tube. An electromagnetic discharge with a wavelength of 253.7 nm results that starts by the ionization and recombination of the electron and the ion, and this wavelength excites the mercury to generate an ultraviolet light with a wavelength of 254 nm. The ultraviolet light excites the fluorescent material spread within the inner wall of the CCFL to emit visible light.

The backlight of the liquid crystal display device uses an inverter to produce a high voltage AC power from a low voltage DC power.

Referring to FIG. 1, the related art backlight driving apparatus of the liquid crystal display device includes: a U-shaped lamp 2; an inverter 4 including transformers 6A, 6B each of which corresponds to a (+) electrode and a (−) electrode of the U-shaped lamp 2; and a connector 8 for connecting the (+)(−) electrodes of the U-shaped lamp 2 with the transformers 6A, 6B respectively.

The backlight driving apparatus of the liquid crystal display device is described in detail in conjunction with FIG. 2. The inverter 4 includes first and second switching parts 32A, 32B that generate the AC voltage in accordance with a control signal of a controller 10; first and second transformers 6A, 6B that are connected to the first and second switching parts 32A, 32B respectively for boosting the generated AC voltage to supply to the U-shaped lamp 2; a voltage detector 20 that detects a voltage of the first and second transformers 6A, 6B and transmits the detected value to the controller 10; and the controller 10 that receives the voltage detected from the voltage detector 20 to control the first and second switching parts 32A, 32B.

The first transformer 6A includes a primary winding 34A; an auxiliary winding 36A; and a secondary winding 38A that generates an AC high voltage by being induced by an AC voltage that is generated in the primary winding 34A by the switching of the first switching part 32A.

The second transformer 6B includes a primary winding 34B; an auxiliary winding 36B; and a secondary winding 38B that generates an AC high voltage by being induced by an AC voltage that is generated in the primary winding 34B by the switching of the second switching part 32B.

Herein, a high end of the primary winding 34A of the first transformer 6A and a low end of the primary winding 34B of the second transformer 6B are connected to each other, and a low end of the primary winding 34A of the first transformer 6A and a high end of the primary winding 34B of the second transformer 6B are connected to each other.

The voltage detector 20 detects the AC high voltage, which is induced at the secondary windings 38A, 38B of the first and second transformers, at the low ends of the secondary windings 38A, 38B, thereby generating a feedback voltage. Detection resistors $R_A$, $R_B$ each connected to the low ends of the secondary windings 38A, 38B enable the voltage detector 20 to detect the feedback voltage.

The controller 10 receives the feedback voltage F/B generated from the voltage detector 20 to control the first and second switching parts 32A, 32B.

In the case where the feedback voltage F/B is larger than a pre-set reference value, the controller 10 controls a duty ratio of first and second switching parts 32A, 32B, thereby making a voltage lower than the reference voltage transmitted to the U-shaped lamp 2.

On the contrary, in the case where the feedback voltage F/B is smaller than the pre-set reference value, the controller 10 controls the duty ratio of the first and second switching parts 32A, 32B, thereby making the voltage higher than the reference voltage transmitted to the U-shaped lamp 2.

In this way, the backlight driving apparatus of the liquid crystal display device of the related art outputs voltages for their phase difference to be 180°, from the secondary windings of the first and second transformers 36A, 36B of the inverter 4, thereby driving the U-shaped lamp 2.

Theoretically, when a voltage with a 180° phase difference is applied to the U-shaped lamp 2 , a virtual ground point of the applied voltage is formed at center of a bent part of the U-shaped lamp 2 , as shown in FIG. 3A.

However, a difference is generated in the size of the voltages V1, V2 of the secondary windings of the transformers due to variations in the inverter parts (transformer, resistor, etc). Also, a DC noise component flows in from the outside, thus a virtual ground point moves in a number ① or ② direction.

In this way, if the location of the virtual ground point is changed, the distance between both electrodes (+),(−) of the U-shaped lamp and the virtual ground point is not identical, but there is a difference. For example, in the case where the virtual ground point is made to move in the number ① direction, the distance between the (−) electrode and the virtual ground point is larger than the distance between the (+) electrode than the virtual ground point, as shown in FIG. 3B.

Accordingly, when a voltage of the same size, e.g., 900V, is applied, a part of the U-shaped lamp to which (−)900V is applied has a relatively lower brightness than a part of the U-shaped lamp to which (+)900V is applied. Further, a phenomenon occurs where mercury is clustered because the part of the U-shaped lamp to which (−)900V is applied becomes relatively colder than the part of the U-shaped lamp to which (+)900V is applied, thus a problem results in that the life span of the lamp is lowered.

SUMMARY OF THE INVENTION

Accordingly, the present invention is directed to an apparatus for driving backlight of light crystal display that substantially obviates one or more of the problems due to limitations and disadvantages of the related art.

An advantage of the present invention is to provide a backlight driving apparatus of a liquid crystal display device that prevents a shift of a virtual ground point of a U-shaped lamp.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a backlight driving apparatus of a liquid crystal display device according to an aspect of the present invention includes: first and second transformers that boost an AC voltage to a boosted AC voltage that is supplied to a U-shaped lamp; and a virtual ground fixing means that causes a virtual ground of the U-shaped lamp to be fixed at the center of a bent part of the U-shaped lamp by causing the boosted AC voltage that is output from the first and second transforming means to be identical in size.

In another aspect of the present invention a backlight driving apparatus of a liquid crystal display device, includes: first and second transformers that boost an AC voltage to a boosted AC voltage that is supplied to a U-shaped lamp; a virtual ground fixing means that causes a virtual ground of the U-shaped lamp to be fixed at the center of a bent part of the U-shaped lamp, the virtual ground fixing means including a first capacitor connected between an output side of the first transformer and a ground and a second capacitor connected between an output side of the second transformer and the ground, wherein the first and second capacitors produce the boosted AC voltage so that it is output from the first and second transforming means to be identical in size.

In another aspect of the present invention a method of driving a backlight having a U-shaped lamp, includes: producing a first AC voltage from a DC voltage; producing a second AC voltage from the DC voltage; filtering the first AC voltage to remove a DC noise component; filtering the second AC voltage to remove a DC noise component; and applying the first and second filtered AC voltages to the U-shaped lamp.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification; illustrate embodiments of the invention and together with the description serve to explain the principles of the invention.

In the drawings.

DETAILED DESCRIPTION OF THE PREFERRED EMBODIMENT

Reference will now be made in detail to the embodiments of the present invention, examples of which are illustrated in the accompanying drawings.

Figure 1:
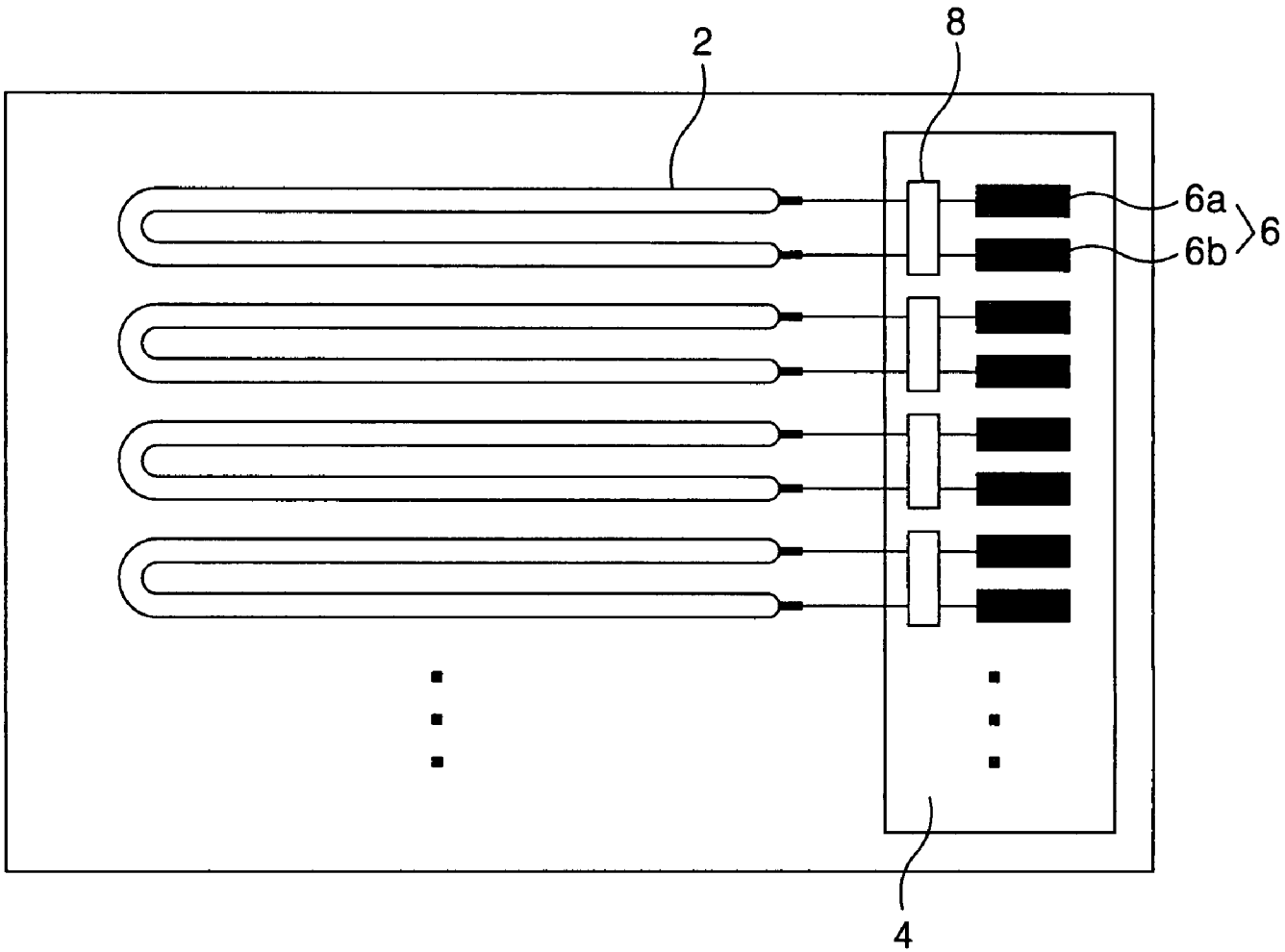
FIG. 1 RELATED ART
FIG. 1 a diagram of a backlight driving apparatus of a liquid crystal display device of the related art.
Figure 2:
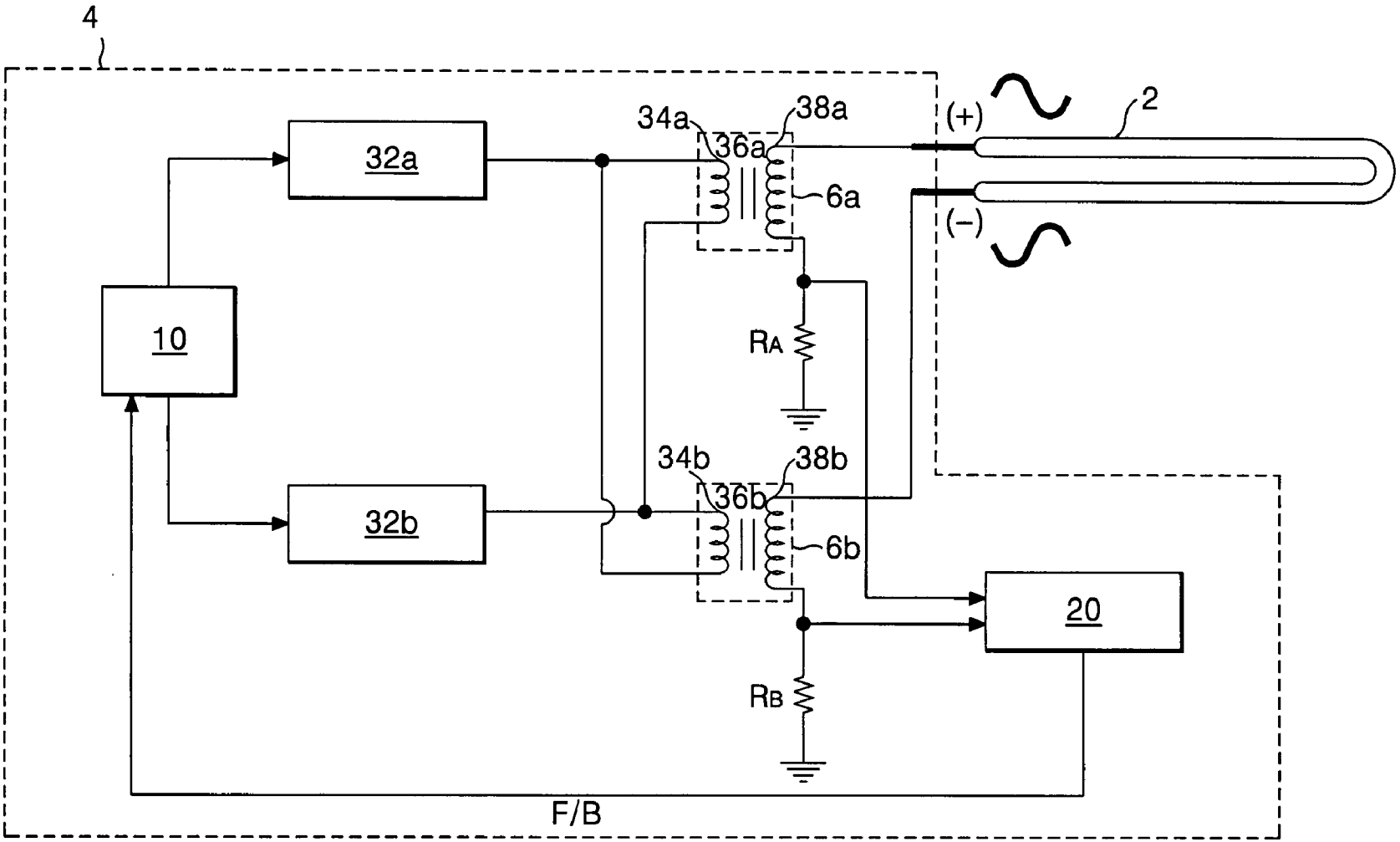
FIG. 2 RELATED ART
FIG. 2 is a circuit diagram for the backlight driving apparatus of the liquid crystal display device of the related art.
Figure 3A:
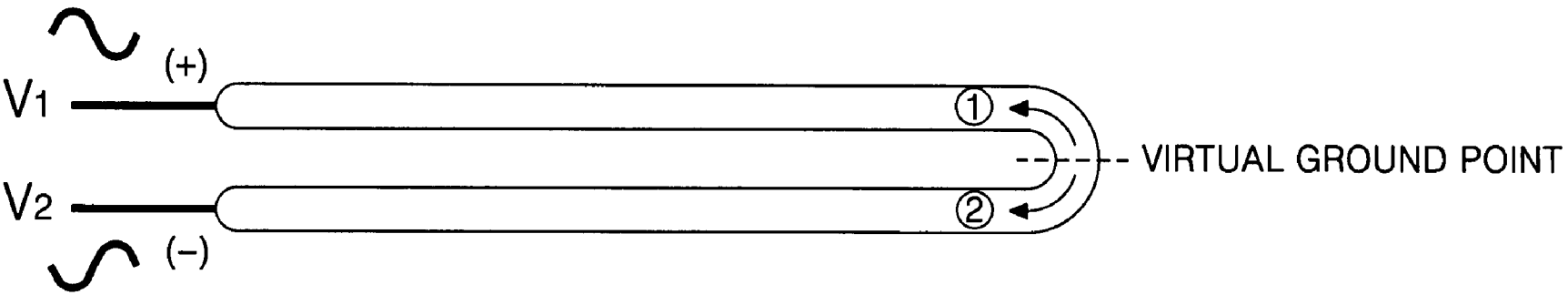
FIG.3A RELATED ART
FIGS. 3A and 3B are diagrams illustrating that a virtual ground point of a U-shaped lamp is shifted.
Figure 3B:
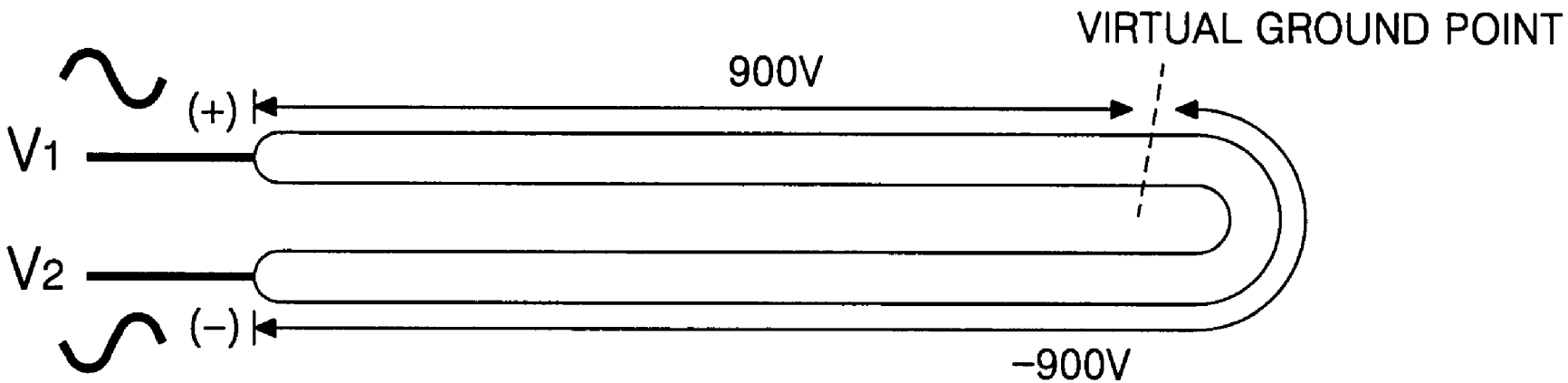
FIG.3B RELATED ART
Figure 4:
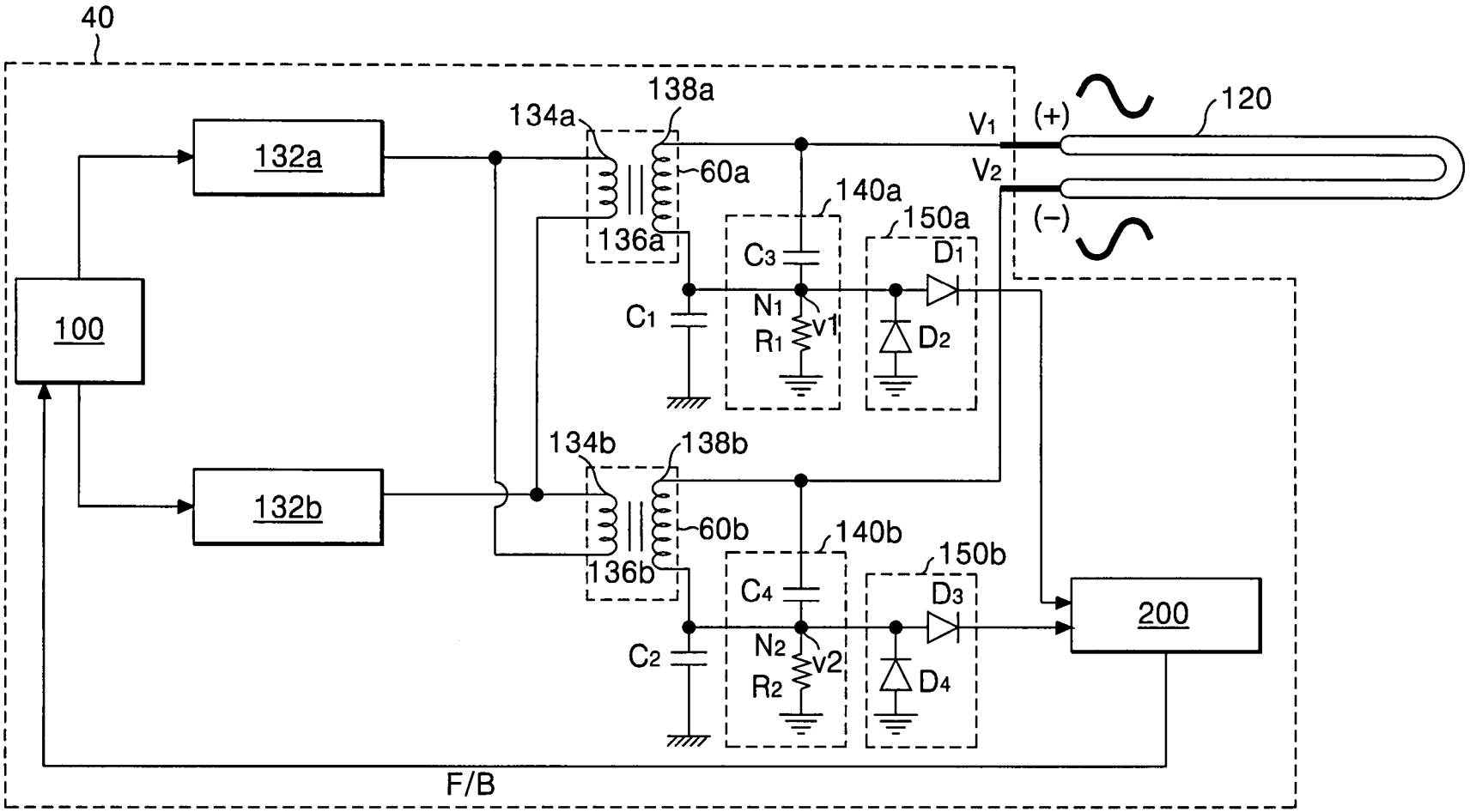
FIG. 4 is a circuit diagram for a backlight driving apparatus of a liquid crystal display device according to the present invention.

FIG. 4 is a circuit diagram for a backlight driving apparatus of a liquid crystal display device according to an embodiment of the present invention.

Referring to FIG. 4, the backlight driving apparatus of the liquid crystal display device according to the present invention includes: a U-shaped lamp 120; an inverter 40 for applying an AC voltage with a 180° phase difference to the (+) and (−) electrodes of the U-shaped lamp 120; and a connector (not shown) for respectively connecting transformers 6A, 6B within the inverter 40 with the (+), (−) electrodes of the U-shaped lamp 120.

The inverter 40includes: first and second switching parts 132A, 132B that generate an AC voltage in accordance with a control signal of a controller 110; first and second transformers 60A, 60B respectively connected to the first and second switching parts 132A, 132B to boost the AC voltage to supply to the U-shaped lamp 120; first and second capacitors C1, C2 respectively connected to lower ends of secondary windings 138A, 138B of the first and second transformers 60A, 60B; first and second voltage dropping parts 140A, 140B for lowering a high voltage of the first and second transformers. 60A, 60B, to a detection voltage; a voltage detector 200 that detects the voltage of the first and second transformers 60A, 60B that is lowered by the voltage dropping parts 140A, 140B to transmit the detected value to the controller 100; and the controller 100 that receives the detected voltage from the voltage detector 200 to control the first and second switching parts 132A, 132B.

The first transformer 60A includes: a primary winding 134A; an auxiliary winding 136A; and a secondary winding 138A that generates an AC high voltage induced by an AC voltage that is generated in the primary winding 134A by the switching of the first switching part 132A.

The second transformer 60B includes a primary winding 134B; an auxiliary winding 136B; and a secondary winding 138B that generates an AC high voltage induced by an AC voltage that is generated in the primary winding 134B by the switching of the second switching part 132B.

A high end of the primary winding 134A of the first transformer 60A and a low end of the primary winding 134B of the second transformer 60B are connected to each other, and a low end of the primary winding 134A of the first transformer 60A and a high end of the primary winding 134B of the second transformer 60B are connected to each other.

The first and second capacitor C1, C2 are respectively connected between the ground and the low ends of the secondary windings 138A, 138B of the first and second transformers 60A, 60B to intercept a DC noise component supplied from the outside and provides a reference ground at the low ends of the secondary windings 138A, 138B of the first and second transformers upon an AC analysis.

To this end, the first and second capacitors C1, C2 may be a high-capacity capacitor of not less than 1000 pF.

The capacitive reactance ($X_c$) is inversely proportional to the capacitance (C) of a capacitor at a fixed frequency (f) in an AC analysis, as in the following mathematical formula. Thus, in case of the present invention, in order to make the voltages of both ends of the capacitor almost '0', the first and second capacitors C1, C2 may be a high-capacity capacitor of not less than 1000 pF.

$$Xc = \frac{1}{2\pi fc} \quad \text{[Mathematical Formula 1]}$$

The first voltage dropping part 140A is includes a first resistor R1 and a third capacitor C3 connected in series and causes the high voltage (V1) of the secondary winding 138A of the first transformer to be lowered to the detection low voltage (v1) in a first node N1.

The second voltage dropping part 140B includes a second resistor R2 and a fourth capacitor C4 connected in series and causes the high voltage (V2) of the secondary winding 138B of the second transformer to be lowered to the detection low voltage (v2) in a second node N2.

A first rectifier 150A includes first and second diodes D1, D2 connected in parallel, and a second rectifier 150B includes third and fourth diodes D3, D4 connected in parallel. Each of the first and second rectifiers 150A, 150B respectively receive the detection low voltage v1, v2 to be changed into DC voltages.

The voltage detector 200 detects the DC voltage generated by the first and second rectifiers 150A, 150B to feedback to the controller 100.

The controller 100 receives the feedback voltage F/B from the voltage detector 200 to control the first and second switching parts 132A, 132B.

To describe the driving of such an inverter 40, AC voltages are generated where the phases are reverse to each other, in the primary windings 134A, 134B of the first and second transformers 60A, 60B by the switching of the first and second switching parts 132A, 132B. Then, the AC high voltage is generated in the secondary windings 138A, 138B of the first and second transformers induced by the AC voltage generated in the primary windings 136A, 136B respectively. For example, if +900V is generated in the secondary winding 138A of the first transformer, −900V is generated in the secondary winding 138B of the second transformer.

The AC high voltage generated in this way is input to the (+), (−) electrodes of the U-shaped lamp 120 connected to the high ends of the secondary windings of the first and second transformers 60A, 60B.

The capacitors C1, C2 each connected to the low ends of the secondary windings 138A, 138B of the first and second transformers 60A, 60B are a high-capacity (not less than 1000 pF) capacitor so that the capacitive reactance is made to be '0', and they act to bypass the DC noise component that flows in from the outside to the ground. Further, the capacitors C1, C2 are made to be connected directly the low ends of the secondary windings 138A, 138B of the first and second transformers 60A, 60B to the ground, thus the capacitors C1, C2 cause the AC high voltages, which are inputted to the (+), (−) electrodes of the U-shaped lamp 120 and of which the phases are reverse to each other, to be identical in size. In this way, the first and second capacitors C1, C2 remove the DC noise component flowing in from the outside and make the AC high voltages, of which the phases are reverse to each other, identical in size, thus a virtual ground point in the U-shaped lamp 120is located at the center of the bent part of the U-shaped lamp 120.

On the other hand, the AC high voltage generated by the first and second transformers 60A, 60B is changed to the detection DC voltage through the first and second voltage dropping parts 140A, 140B and the first and second rectifiers 150A, 150B to be input to the voltage detector 200. The detection DC voltage input in this way is fed back to the controller 100, and the controller 100 receives the feedback voltage F/B from the voltage detector 200 to control the first and second switching parts 132A, 132B.

In the case where the feedback voltage F/B is larger than a pre-set reference value (for example, +900V, −900V), the controller 100 controls a duty ratio of first and second switching parts 132A, 132B, thereby producing a voltage lower than the reference voltage transmitted to the U-shaped lamp 200.

On the contrary, in the case where the feedback voltage F/B is smaller than the pre-set reference value, the controller 100 controls the duty ratio of the first and second switching parts 132A, 132B, thereby producing a voltage higher than the reference voltage transmitted to the U-shaped lamp 200.

The backlight driving apparatus of the liquid crystal display device according to the present invention includes the first and second capacitors C1, C2 of high capacity at the low ends of the secondary windings 138A, 138B of the first and second transformers of the inverter 40 to ground the low end of the secondary winding, thereby causing the DC noise component flowing in from the outside to be bypassed to the ground and making the AC high voltages, which are supplied to the U-shaped lamp 120 and of which the phases are reverse to each other, identical in size.

As described above, the backlight driving apparatus of the liquid crystal display device according to the present invention includes the high-capacity capacitor at each of the low ends of the secondary windings of the first and second transformers of the inverter, thereby making the AC high voltages, which are supplied to the U-shaped lamp 120 and of which the phases are reverse to each other, identical in size and enabling the noise of DC component flowing in from the outside to be removed.

Accordingly, the virtual ground point of the U-shaped lamp located at the center of the bending part of the U-shaped lamp, thereby preventing the partial picture quality deterioration and the lamp life span reduction that are generated by the shift of the virtual ground point.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A backlight driving apparatus of a liquid crystal display device, comprising:

first and second transformers that boost an AC voltage to a boosted AC voltage that is supplied to a U-shaped lamp; and a virtual ground fixing means that causes a virtual ground of the U-shaped lamp to be fixed at the center of a bent part of the U-shaped lamp by causing the boosted AC voltage that is output from the first and second transforming means to be identical in size.

2. The backlight driving apparatus according to claim 1, wherein the virtual ground fixing means includes first and second virtual ground fixing parts for producing the boosted AC voltage that is output from the first and second transforming means to be identical in size.

3. The backlight driving apparatus according to claim 2, wherein the first virtual ground fixing part includes a first capacitor connected between an output side of the first transformer and a ground.

4. The backlight driving apparatus according to claim 3, wherein the second virtual ground fixing part includes a second capacitor connected between an output side of the second transformer and the ground.

5. The backlight driving apparatus according to claim 4, wherein the first and second capacitors are a high-capacity capacitor of not less than 1000 pF.

6. The backlight driving apparatus according to claim 5, wherein the first and second capacitors remove a DC noise component that flows in from outside the backlight driving apparatus.

7. The backlight driving apparatus according to claim 1, further comprising:

first and second rectifiers that receive the boosted AC voltage from the first and second transformers and that produce a first and second rectified DC voltage;

a voltage detector that detects the first and second rectified DC voltages and that produces a control signal based upon the detected first and second rectified DC voltages; and a controller that receives the control signal and that controls first and second switching elements that produce the AC voltage.

8. A backlight driving apparatus of a liquid crystal display device, comprising:

first and second transformers that boost an AC voltage to a boosted AC voltage that is supplied to a U-shaped lamp;

a virtual ground fixing means that causes a virtual ground of the U-shaped lamp to be fixed at the center of a bent part of the U-shaped lamp, the virtual ground fixing means including a first capacitor connected between an output side of the first transformer and a ground and a second capacitor connected between an output side of the second transformer and the ground, wherein the first and second capacitors produce the boosted AC voltage so that it is output from the first and second transforming means to be identical in size.

9. The backlight driving apparatus according to claim 8, wherein the first and second capacitors are a high-capacity capacitor of not less than 1000 pF.

10. The backlight driving apparatus according to claim 9, wherein the first and second capacitors remove a DC noise component that flows in from outside the backlight driving apparatus.

11. The backlight driving apparatus according to claim 8, further comprising:

first and second rectifiers that receive the boosted AC voltage from the first and second transformers and that produce a first and second rectified DC voltage;

a voltage detector that detects the first and second rectified DC voltages and that produces a control signal based upon the detected first and second rectified DC voltages; and a controller that receives the control signal and that controls first and second switching elements that produce the AC voltage.

12. A method of driving a backlight having a U-shaped lamp, comprising:

producing a first AC voltage from a DC voltage;

producing a second AC voltage from the DC voltage;

filtering the first AC voltage to remove a DC noise component;

filtering the second AC voltage to remove a DC noise component; and applying the first and second filtered AC voltages to the U-shaped lamp.

13. The method according to claim 12, wherein producing the first and second AC voltages further includes boosting first and second intermediate AC voltages into the first and second AC voltage using AC transformers.

14. The method according to claim 13, wherein filtering the first and second AC voltages includes using first and second capacitors.

15. The method according to claim 14, wherein the first and second capacitors are a high-capacity capacitor of not less than 1000 pF.

16. The method according to claim 12, further including detecting the first and second AC voltages.

17. The method according to claim 16, further including producing a control signal based upon the detected first and second AC voltages.

18. The method according to claim 17, further including producing the first and second AC voltages based upon the control signal.

* * * * *